US006786709B1

(12) United States Patent
Klahm et al.

(10) Patent No.: US 6,786,709 B1
(45) Date of Patent: Sep. 7, 2004

(54) GEAR PUMP WITH A DRIVE AND A HYDRAULIC TANK

(75) Inventors: Harald Klahm, St. Ingbert (DE); Rudiger Jung, St. Ingbert (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 205 days.

(21) Appl. No.: 10/069,392

(22) PCT Filed: Sep. 5, 2000

(86) PCT No.: PCT/EP00/08643

§ 371 (c)(1),
(2), (4) Date: Feb. 26, 2002

(87) PCT Pub. No.: WO01/18397

PCT Pub. Date: Mar. 15, 2001

(30) Foreign Application Priority Data

Sep. 7, 1999 (DE) ..... 199 42 567

(51) Int. Cl.[7] ..... F04C 29/00
(52) U.S. Cl. ..... 418/39; 137/271; 137/565.19
(58) Field of Search ..... 137/269, 271, 137/565.17, 565.19; 418/9, 39, 206.1, 206.4

(56) References Cited

U.S. PATENT DOCUMENTS 1,218,300 A * 3/1917 Nelson ..... 418/9
2,984,187 A * 5/1961 Prasse et al. ..... 137/565.17
3,515,167 A 6/1970 Svenson
6,004,119 A * 12/1999 Hamasaki et al. ..... 418/206.1
6,158,983 A * 12/2000 Harpole et al. ..... 418/206.1
6,322,329 B1 * 11/2001 Vera ..... 418/206.1
6,506,029 B1 * 1/2003 Reichenmiller ..... 418/206.4

FOREIGN PATENT DOCUMENTS

| | | |
|---|---|---|
| DE | 3227926 | 2/1984 |
| DE | 29601201 | 3/1996 |
| DE | 19514749 | 10/1996 |
| DE | 19627405 | 1/1998 |
| EP | 0886067 | 12/1998 |

* cited by examiner

*Primary Examiner*—John Rivell
(74) *Attorney, Agent, or Firm*—Roylance, Abrams, Berdo & Goodman, L.L.P.

(57) ABSTRACT

A device for pumping fluid has a hydraulic pump (10) and a drive (12). The hydraulic pump (12) is produced as an independent component with different types of drive devices (12) as additional components that can be coupled in the form of a modular system, and is configured as a coupling piece (14) for this purpose. Hydraulic tanks (16) having different volumes represent a third, different type of component. Each hydraulic tank (16) can be connected on one side to the coupling piece (14). The corresponding drive device (12) can be connected on the opposite or same side of the coupling piece (14). The coupling piece (14) is built as a single component and embodied in the form of a base plate. The hydraulic pump (10) is an external gear pump (20), whose toothed wheels (22) are received or integrated into the base plate. A compact, modularly constructed building block system is achieved which is functionally reliable and easy to maintain.

16 Claims, 3 Drawing Sheets

GEAR PUMP WITH A DRIVE AND A HYDRAULIC TANK

FIELD OF THE INVENTION

The present invention relates to a device for pumping fluid with a hydraulic pump and a drive mechanism. The hydraulic pump is an external gear pump and is an independent component capable of being coupled to various types of drive mechanisms as additional components in the manner of a building block system. For this reason, it is in the form of a one-piece coupling piece. Various hydraulic tanks, especially ones with different tank capacities, are provided as a third type of component. A particular hydraulic tank on one side is connectible to the coupling piece. The particular drive mechanism on the other, opposite side is connectible to this coupling piece. For such purpose, the coupling piece on at least one side has a flange element. Sealing means are provided between coupling piece and drive mechanism as well as the hydraulic tank.

BACKGROUND OF THE INVENTION

DE-A-195 14 749 describes a device for pumping fluid with a radial piston pump as hydraulic pump and a drive mechanism for driving the pump. The conventional device is likewise modular in structure in the manner of a building block system. The independent component forms a multipart element with the radial piston pump, and is built correspondingly large axially so that the conventional pump device is on the whole large and cannot be used in every installation case, especially under cramped installation conditions. In addition, because of the large number of individual piston pump elements required for the radial piston pump, susceptibility to breakdowns in operation is natural to a certain degree. In view of the great variety of parts, production and use of the radial piston pump as a hydraulic pump are also expensive.

Such pump devices, which are also called pump assemblies, are used among other things for hoisting and also lowering loads by hydraulic mechanisms, for example, in the area of cargo platforms in trucks, automobile platform lifts, mobile elevating platforms, or the like. In the mobile motor vehicle area, in which frequently only battery power is available, direct-current motors are used as drive mechanisms. In contrast, in the area of commercial firm installations or the like where direct current is available, the relevant pump device with a rotary current motor is employed.

In the relevant conventional solutions (e.g., DE-U-296 01 201), a special assembly solution is available for each special application, one which meets the special operating requirements. Since an independent technical concept is to be made available for each application, such solutions are expensive to apply in production. A large number of different structural shapes and structural components must be stocked as a function of customer requirements.

As a further development of the concept of configuring pumping devices or pump assemblies as a modular building block system, DE-A-32 27 926 proposes providing a hydraulic unit with a flange-like base plate on one side surface. On that one side, a hydraulic pump is removably fastened along with a housing tightly enclosing the pump and serving as container for the hydraulic medium. On the other side surface, an electric motor is mounted removably and opposite the pump. The motor drive shaft extends perpendicularly to the two side surfaces. In this conventional solution the hydraulic pump is a component of the hydraulic tank. This arrangement reduces the storage capacity. The flange-like base plate, in contrast, is provided with drill holes, perforations or the like forming all the connecting lines required for mounting of various hydraulic pumps, motors, valves, control elements, or the like. They end on one side or peripheral surface of the flange-like base plate, where fastening means for the components and for their connection are provided. The relevant conventional hydraulic unit as a pumping device is large in size and cannot be employed in every application if the space available for mounting is especially restricted.

DE-A-196 27 405 discloses a device for pumping fluid. The conventional pump layout includes a hydraulic tank with a filter and external gear pump connected by a drive shaft to an electric motor. The hydraulic tank and electric motor are mounted on opposite sides of the pump housing, which serves as coupling piece. The electric motor engages an annular recess in an end plate on an accompanying adjustable flange of this end plate. The hydraulic tank is held in place by a clamp on a flange-like seating surface. As viewed along a longitudinal section following the longitudinal axis of the pump layout, the pump housing is T-shaped in outline graduated through various widths. Replacement of the hydraulic tank on the side of the coupling piece with the drive mechanism is not possible, so that the possibility of adaptation to comply with stated customer wishes is restricted.

SUMMARY OF THE INVENTION

Objects of the present invention are to provide improved devices for pumping a fluid so that the manufacturing and overall costs are reduced and that a large number of customer wishes can be satisfied with a small number of components.

Other objects of the present invention are to provide a reliably operating pump unit, without the need for reducing the capacity of a tank container, which can be installed under extremely cramped installation conditions to conserve space and yet is just as efficient as a comparable conventional products.

The foregoing objects are basically attained with a hydraulic tank, a drive mechanism and a hydraulic pump housed in a coupling piece in the form of a base plate. On its side opposite the flange element, the coupling piece has another flange element adapted to the first flange element from the viewpoint of its external dimensions. Both flange elements have on their outer circumference a radial recess for engagement of a sealing means which may be overlapped by the free end of the hydraulic tank. The hydraulic tank and the drive mechanism can be connected while together on one side or on opposite sides of the coupling element. The pump device can be assembled as a compact unit for a large number of applications with the smallest possible number of components. In the process, the components already available may be combined at will with each other in accordance with customer instructions to form a marketable unit. Hence, the device of the present invention yields a building block system. Equivalent parts are used to produce a large variety of different embodiments at low cost. In this instance, the hydraulic tank may incorporate the drive mechanism and be mounted together with such drive mechanism on the side of the coupling piece provided for this purpose.

The hydraulic pump is incorporated and fully integrated into the base plate in the form of an external gear pump. The entire capacity of the tank unit to be connected is available. In addition, as a result of integration of the external gear pump, the length of the fluid lines and control lines is reduced. Such reduction facilitates reliability in operation with low pressure losses. Since the external gear pump has only two gears as actuating and drive elements, installation space is conserved and is cost effective. Such arrangement also promotes reliability of operation. In addition, the external gear pump is easier to design on the basis of its volume throughput for a wide variety of applications. It is easier to design the fuel pump on the basis of its geometric dimensions.

In addition, in the event of breakdown and for maintenance purposes, the hydraulic pump may be replaced simply by replacing the coupling piece. Because of the plate like configuration of the coupling piece, the hydraulic pump itself is easily accessible for purposes of repair and maintenance.

Other objects, advantages and salient features of the present invention will become apparent form the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
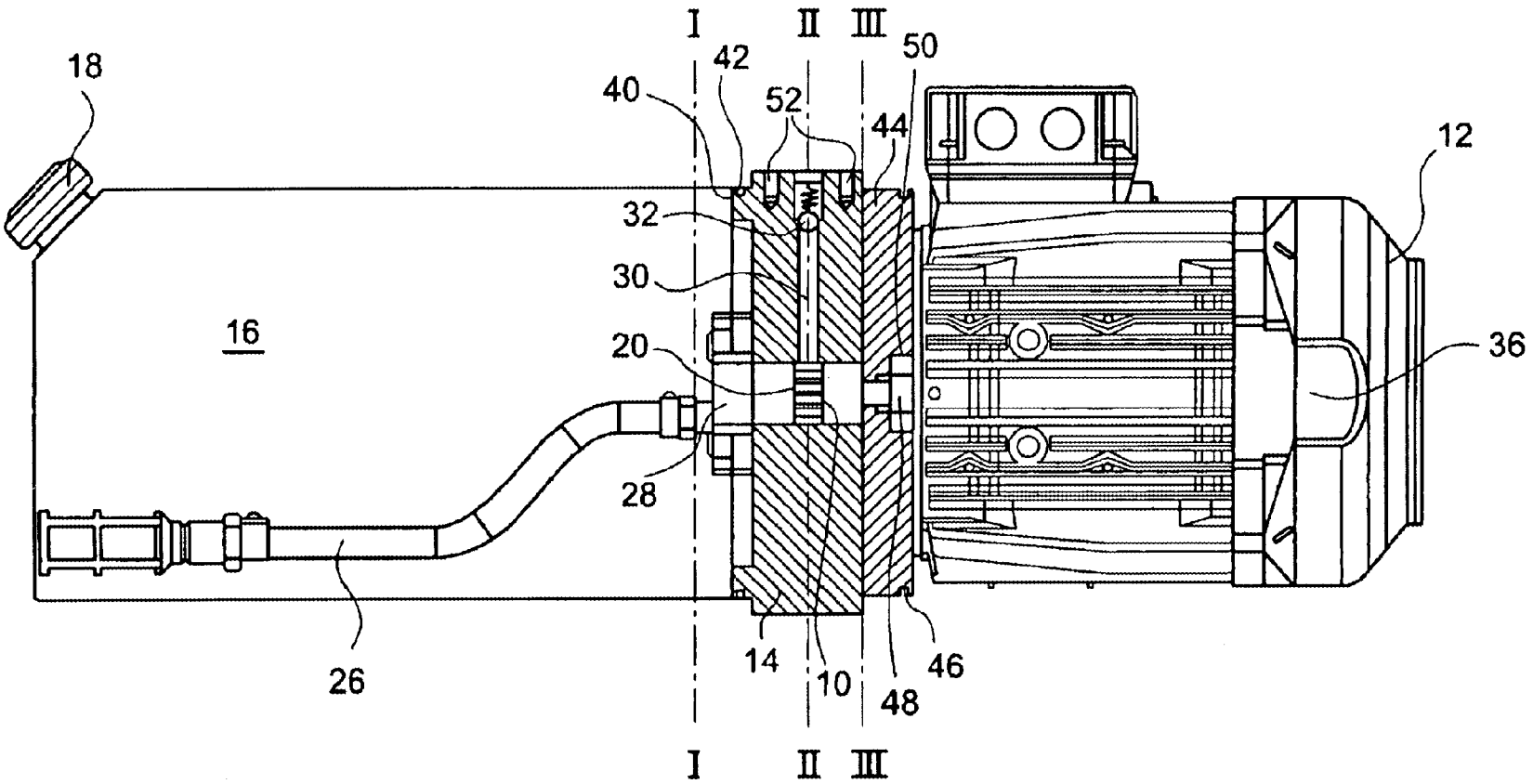
FIGS. 1–3 are side elevational views in section of a pump device with various drive units according to an embodiment of the present invention.
Figure 2:
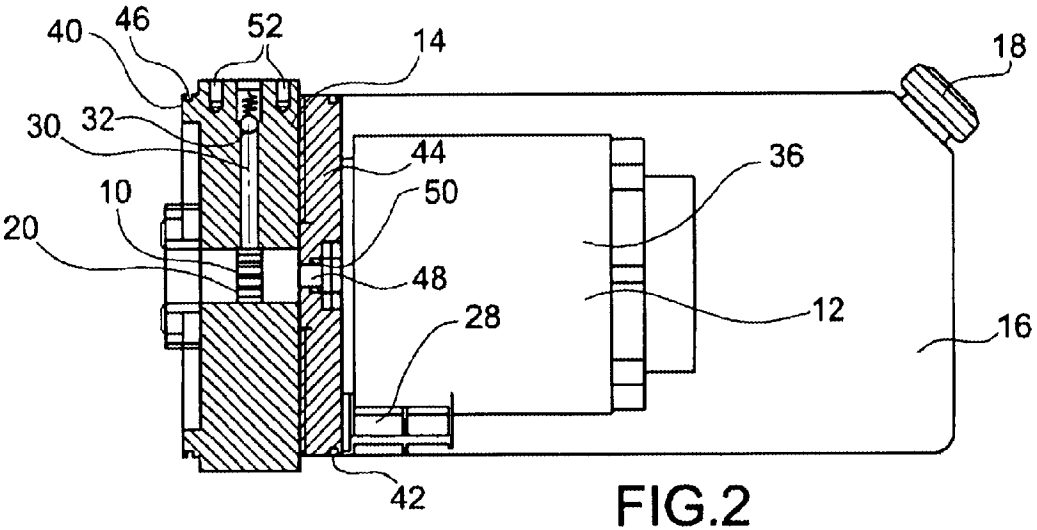
Figure 3:
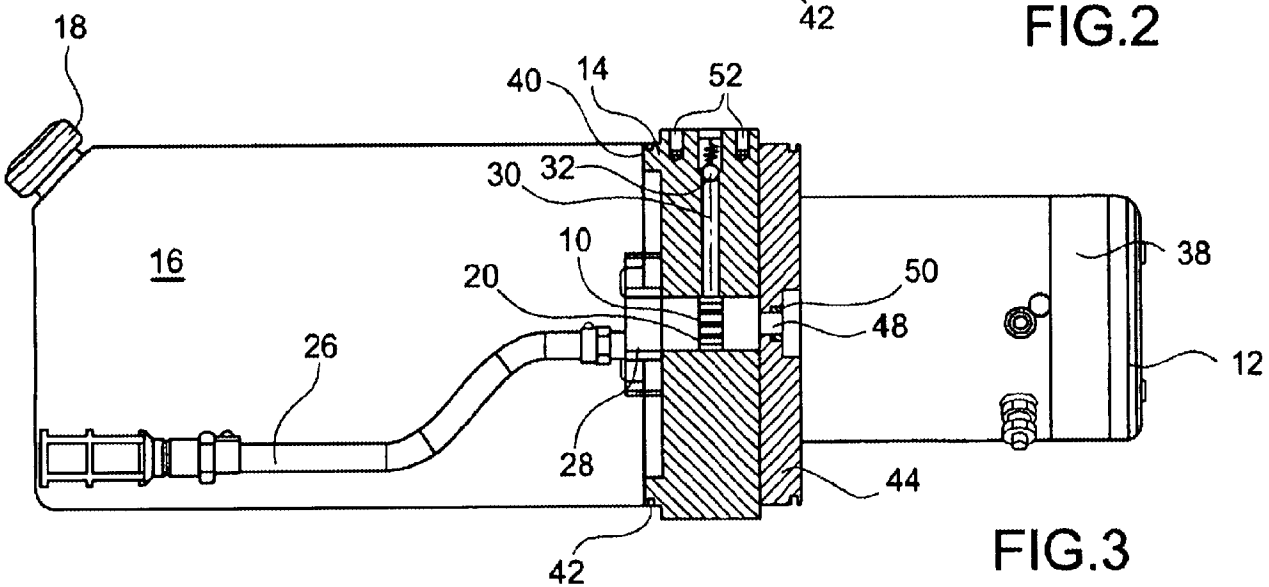

The device in the drawing figures is used for pumping, and thus, delivery of fluid by a hydraulic pump 10 powered by a drive mechanism 12. The hydraulic pump 10, as an independent modular component, may be coupled with various types of drive mechanisms 12 as additional components in the manner of a building block system. For this purpose, the pump is in the form of a coupling piece element 14 on the housing. A third type of component is represented by various hydraulic tanks 16, especially ones with different tank capacities. The particular hydraulic tank 16 is connectible on one side to the coupling piece 14. A particular drive mechanism 12 is connected on the other, opposite side (FIGS. 1 and 3) or on the same side (FIG. 2) to the coupling piece 14. In FIGS. 1 to 3, essentially only one type of hydraulic tank 16 is shown, one which may be refilled with fluid, especially hydraulic fluid, by way of a refill connector 18.

In accordance with the embodiment shown as a hydraulic pump 10, the coupling piece 14 has an external gear pump 20 with two meshing gears 22 as conveying means. The gears 22 of the gear pump 20 are mounted in a pump chamber 24 of the coupling piece 14 and are rotatably guided in bearing bushes (not shown) of the coupling piece 14.

The interior of a given connected hydraulic tank 16 is connected to the interior of the pump chamber 24 by a suction channel 26, specifically, at the point of transition to the coupling piece, by a suction or intake flange 28 (FIGS. 1 and 3). In the case of the building block alternative shown in FIG. 2, in which the drive mechanism 12 is integrated inside the hydraulic tank 16, the suction channel 26 may be omitted and fluid is delivered directly by the suction flange 28 mounted on the drive mechanism 12.

Figure 4:
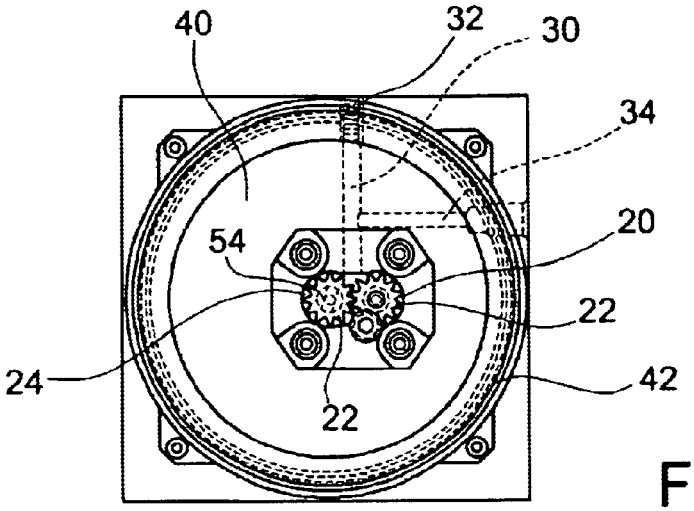
FIGS. 4–6 are end elevational views in section of the pump device taken along lines I—I, II—II and III—III of FIG. 1, respectively.
Figure 5:
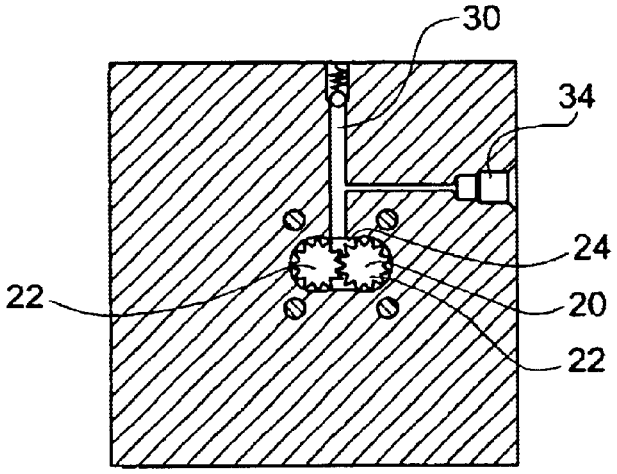
Figure 6:
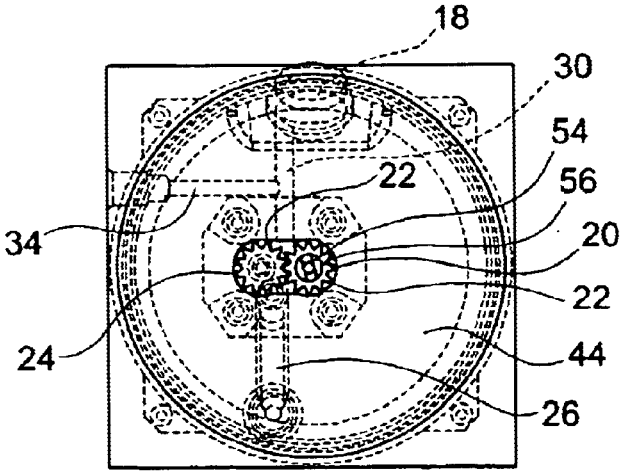

Inside the coupling piece 14, in the line of vision as shown in the figures, a delivery line 30 extends vertically connecting the pump chamber 24 to the exterior for conducting fluid. On the free end of the delivery line 30 extending to the exterior this line is closed by a spring loaded return valve 32. Valve 32 opens by overcoming the force of the spring as soon as the hydraulic pump 10 begins operating to supply a consuming device, such as one in the form of a hoisting device for a platform lift, automotive platform hoist or the like, with pressurized liquid. As shown in FIGS. 4 to 6 in particular, a branch line 34 is connected to a pressure protection mechanism or valve (not shown) to protect the hydraulic system from pressure peaks, as overload protection discharges transversely into the delivery line 30. As also shown in FIGS. 4 and 6, the feed opening of the intake flange 28 discharges only partly into the pump chamber 24 with gear pump 20.

The drive mechanism 12 is an electric motor, especially a rotary current motor 36 as illustrated in FIGS. 1 and 2, or a direct-current motor 38 as shown in FIG. 3. The rotary-current motor 36, in the illustration of FIG. 2, is mounted inside the hydraulic tank 16, and is an integral part of the tank. The associated pump assembly, with so-called suboil motor, consequently occupies less structural space, but reduces the amount of fluid available in the hydraulic tank 16. In a further embodiment, a hydraulic drive would also be conceivable as drive mechanism 12. In FIGS. 1 to 3, the coupling piece 14 has, on its one free end, a flange element 40 that can be overlapped by the free end of the particular hydraulic tank 16. Sealing means 42, in the form of a sealing ring, is mounted at the location of the pertinent overlap. On the opposite side, the coupling piece 14 has another flange element 44 in a form of a cover. Flange element 44 may be connected to the hydraulic tank and/or to the drive mechanism 12.

By its outer dimensions, the additional flange element 44 is adapted to the flange element 40 and, like the flange element 40, provides on its outer circumference a radial recess 46 for sealing means 42 for when the tank 16 is mounted on flange element 44 as shown in FIG. 2. Each of the two flange elements 40 and 44 have, in the center, an annular recess for insertion of the intake flange 28 or for introduction of the relevant drive line 48 of the drive mechanism 12. The drive mechanism 12 with its drive line 48 may thus be coupled to the hydraulic pump 10. A fluid seal 50, in the form of a ring seal, is at least at the site of the drive line 48 inside the other flange element 44. In this way, a reliable fluid seal of the interior of the pump device from the exterior is achieved by use of this sealing means.

As continuation of the modular building block system with various drive mechanisms 12, as viewed in the line of sight in the figures, a control mechanism (not shown) may be present on the top of the coupling piece 14. The control mechanism which may be connected to the coupling piece 14 by way of boreholes 52. The relevant control mechanism may contain hydraulic control elements for delivery of fluid to the consuming device, as well as entire hydraulic control units. The individual components of the modular pump assembly may be connected to each other by conventional screw connections. Since the hydraulic tank 16 represents a closed structural unit, the pump assembly is operated as a closed system, that is, only the fluid content of the hydraulic tank 16 is used to supply a consuming device to be actuated.

Since the fluid conducting lines are integrated into the coupling piece 14, in contrast to conventional solutions, no separate sealing or piping is necessary. In particular, the flange elements may be ideally produced in a cost effective manner from cast elements. The drive mechanisms 12 in question may be represented by external elements. The material embodiment of the tank 16 may be of plastic or sheet steel. The embodiment of the gear pump 20 itself may be pressure compensated or not pressure compensated.

The gear pump 20 proper with its external gears 22 lies, as viewed in the direction of sight in the figures, together with the feed line 30, in a central plane extending vertically of the flange-like coupling piece 14. The drive shafts for the gears 22 lie, together with the longitudinal axes of the drive line 48, in planes transverse to the longitudinal center plane in question, represented by line II—II in FIG. 1 (cf. FIG. 5). The free end of the drive line 48 may be in form like a connecting pin engaged in a recess 54 in the cylindrical drive element 56 for one of the two gears 22. Only one gear 22 needs to be driven in this way by the drive line 48. The gear 22 driven in this manner entrains the other gear 22 for a pumping process by corresponding meshing of the two sets of gear teeth.

With the device of the present invention, the coupling piece 14 is the hydraulic pump 10 and is the central structural unit, which may be coupled at will to hydraulic tanks 16, drive mechanisms 12, and to control mechanisms (not shown), as well as to consuming devices, to form a system. The coupling piece 14 is in the form of an integral solid base plate element, like a mounting plate, penetrated only by the feed and control lines referred to and by the gear elements of the gear pump 20. The gears 22 of the external gear pump 20 are mounted more or less in the center of the solid base plate of the coupling piece 14, so that a low-vibration drive is obtained during operation. This condition promotes achievement of continuous feed of a stream of fluid.

While various embodiments have been chosen to illustrate the invention, it will be understood by those skilled in the art that various changes and modifications can be made therein without departing from the scope of the invention as defined in the appended claims.

What is claimed is:

1. A device for pumping fluid, comprising:

a hydraulic tank;

a drive mechanism; and a hydraulic pump with an external gear pump mechanism coupled to said drive mechanism, said gear pump mechanism being housed in an integral coupling piece in a form of an independent base plate with a first and second sides connected to said hydraulic tank and said drive mechanism, said first and second sides having first and second flange elements, respectively, with substantially similar external dimensions, said flange elements having an external circumferential sides with radial recesses receiving seals overlapped by a free end on at least one of said hydraulic tank and said drive mechanism;

whereby, differently sized hydraulic tanks and different types of drive mechanisms can be interchangeably coupled to said coupling piece in a manner of a building block system with said hydraulic tank, said drive mechanism and said hydraulic pump being three separable and independent components of the system, and with said hydraulic tank and said drive mechanisms being on one of said first side and said first and second sides, respectively.

2. A device according to claim 1 wherein said pump mechanism comprises gears fully contained in and integral with said coupling piece.

3. A device according to claim 2 wherein said gears are in a pump chamber of said coupling piece and are rotatably mounted in bearing bushings of said coupling piece.

4. A device according to claim 3 wherein a suction line connects said hydraulic tank to an interior of said pump chamber for conveying fluid.

5. A device according to claim 4 wherein a feed line extends inside said coupling piece and inside said pump chamber; and a tap line opens into said feed line for a pressure relief safety.

6. A device according to claim 1 wherein said drive mechanism comprises an electric motor.

7. A device according to claim 6 wherein said electric motor is a rotary current motor.

8. A device according to claim 6 wherein said electric motor is a direct-current motor.

9. A device according to claim 6 wherein said electric motor is a suboil motor in said hydraulic tank.

10. A device according to claim 1 wherein said drive mechanism is a hydraulic drive.

11. A device according to claim 1 wherein said drive mechanism comprises a drive line coupled to said hydraulic pump; and a fluid seal is at a site of said drive line.

12. A device according to claim 1 wherein said pump mechanism comprises gears in a vertically extending central plane of said coupling piece, and drive shafts for said gears; and said drive mechanism comprises a drive line, said drive shafts and said drive line extending transverse to said central plane.

13. A device according to claim 1 wherein said hydraulic tank is a closed structural unit; and only fluid contents of said hydraulic tank supply a consuming device in fluid communication with said pump mechanism.

14. A device according to claim 1 wherein said hydraulic tank and said drive mechanism are coupled on said first and second sides of said base plate, respectively.

15. A device according to claim 1 wherein said hydraulic tank and said drive mechanism are both coupled on said first side of said base plate.

16. A device according to claim 15 wherein said drive mechanism is housed inside said hydraulic tank.

* * * * *